United States Patent [19]

Wiemer

[11] 4,201,346

[45] May 6, 1980

[54] DEVICE FOR CRUSHING SINTER AND THE LIKE

[75] Inventor: Erich Wiemer, Essen, Fed. Rep. of Germany

[73] Assignee: Krupp-Koppers GmbH, Essen, Fed. Rep. of Germany

[21] Appl. No.: 939,746

[22] Filed: Sep. 5, 1978

Related U.S. Application Data

[63] Continuation of Ser. No. 811,686, Jun. 30, 1977, abandoned.

[30] Foreign Application Priority Data

Jul. 16, 1976 [DE] Fed. Rep. of Germany ..... 2632061

[51] Int. Cl.[2] ..... B02C 13/02; B02C 23/18

[52] U.S. Cl. ..... 241/66; 241/187; 241/190

[58] Field of Search ..... 241/66, 187, 189 R, 241/190, 236

[56] References Cited

U.S. PATENT DOCUMENTS

| | | | |
|---|---|---|---|
| 1,419,407 | 6/1922 | Pardee | 241/187 |
| 2,043,328 | 6/1936 | Mosshart | 241/236 X |
| 2,121,453 | 6/1938 | Sundstrand | 241/236 X |
| 2,921,488 | 1/1960 | Davis | 241/66 UX |
| 3,064,907 | 11/1962 | Biehn | 241/236 X |
| 3,396,914 | 8/1968 | Liebman | 241/187 X |

*Primary Examiner*—Howard N. Goldberg
*Attorney, Agent, or Firm*—R. Lawrence Sahr

[57] ABSTRACT

A device for crushing sinter and other material of like consistency is disclosed wherein the flow sinter material is deployed against an impact table which directs the sinter material downward onto a series of vertically disposed discs fixed to a common means of rotation. The common means of rotation intersects each disc through its central axis. Adjacent to the discs and parallel to the common means of rotation is positioned a shaft upon which are mounted crusher means arranged to intersect and pass between the discs. As sinter is directed downward onto the discs, the crusher means rotates and forces the sinter between the discs, thus crushing it. Heat buildup in the discs is controlled by a means of cooling which impinges on the discs.

5 Claims, 3 Drawing Figures

DEVICE FOR CRUSHING SINTER AND THE LIKE

This is a continuation of application Ser. No. 811,686, filed June 30, 1977, now abandoned.

BACKGROUND OF THE INVENTION

1. Field of the Invention

This invention relates to the manufacture of sinter and, more particularly, to the crushing of sinter to size it for further use.

2. Description of the Prior Art

Commonly, in the manufacture of sinter, the sinter material, after it is composed, is crushed to a more or less uniform size. To perform this operation a crushing device is required. The crushing device usually comprises a grate of beams mounted horizontally (sometimes sloped). The beams are parallel and spaced apart. Crushing arms are arranged to move interspaced between the beams such that sinter material deployed upon the grate is forced between the beams and, thus, crushed to a more or less uniform size.

Such an arrangement of the beams and crushing arms causes a high degree of localized stress to be exerted on the beams resulting in fatigue and consequential breakage of the beams. This problem is augmented by the heat inherent in the sinter material as it is deployed onto the grate from sintering furnaces.

Since the crushing action is localized on the grate to a particular portion of the beams, a high degree of wear rapidly develops on the beams.

The result of these two problem areas is a need for frequent replacement of the beams with attendant downtime of the crushing device and significant replacement costs. There is a need for a crushing device which can overcome these downtime and replacement cost factors by increasing the life of the grate.

SUMMARY OF THE INVENTION

A grate is formed of discs mounted to a common horizontal shaft, in a spaced-apart manner with the horizontal axle intersecting each disc and forming a central axis therethrough. The discs can be of different symetrical forms. Using circular forms, the discs would rotate under the influence of the sinter material moved by the crusher arms, the rotation being in a direction opposite to the movement of the crusher arms. The discs could, alternately, be driven by the crusher arm drive means or could have independent disc rotation drive means.

As a result of the rotation of the discs, the wear is spread evenly over the complete periphery of the disc. Further, the heat is equalized throughout the disc. Finally, due to the rotation of the disc, stress points are spread over the entire disc and not concentrated upon a given point, as in the prior art designs. As a result, the discs have a longer life span than the beams used in the prior art.

Since the discs are rotated, a cooling fluid, for example, water, may be impinged on the areas of the disc not in service at a given moment, without contacting the sinter material being crushed. Thus, the life of the discs may be further extended.

An alternate embodiment of the crushing device would use discs of symetrical polygonal shapes, including flat peripheral sides. Each side would be indexed in relation to the crushing motion of the crushing arms. In this embodiment all of the discs' peripheral flats must be parallel; the discs would be keyed to the common horizontal axle and the shaft itself would rotate. A corollary alternate to this embodiment is to maintain the parallel peripheral flats in a fixed position until wear appears, followed by a partial rotation of the common horizontal shaft to bring a new set of flats into working relationship with the crusher arms.

Finally, a sloping impact table is provided adjacent to the discs. As the sinter material is deployed into the crushing device and where it is contacted by the crusher arms, the initial impact stress is absorbed by the table, thus eliminating the localized stress inherent in the prior art device.

These and other features of this invention will be more completely disclosed and described in the following specification, the accompanying drawings and the appended claims.

DETAILED DESCRIPTION

Figure 1:
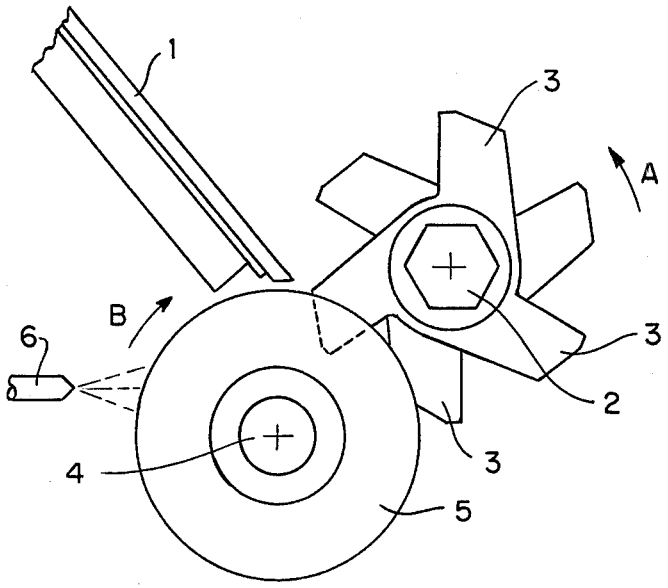
FIG. 1 is a side view of the preferred embodiment of the crushing device, as provided with circular discs, in schematic form.
Figure 2:
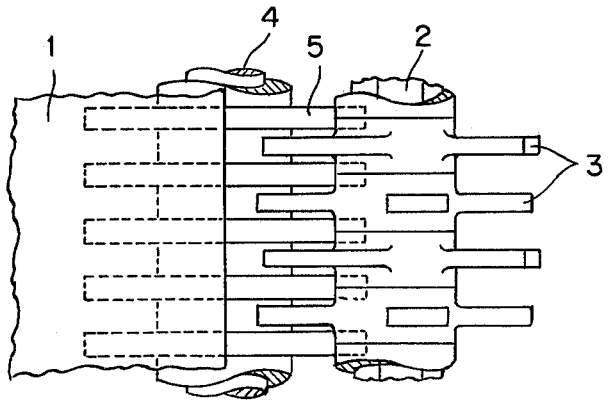
FIG. 2 shows a partial top view of the preferred embodiment of the crushing device, as provided with circular discs, in schematic form.

FIG. 1 and FIG. 2 show an impact table 1 positioned to slope in relation to the vertical deployment of sinter material. The impact shock of the falling sinter material is absorbed by the impact table 1.

The crusher means is positioned at the lower edge of the impact table 1 and comprises a horizontal shaft 2, positioned parallel to the lower edge of the impact table 1, and a plurality of crusher arms 3 fixed to the horizontal shaft 2. The horizontal shaft intersects the crusher arms 3, passing through the central axis of the crusher arms 3 as illustrated in FIG. 2. The crusher arms 3 are spaced apart from each other as illustrated in FIG. 2. The horizontal shaft 2, and thus, the crusher arms 3, rotates in the direction of arrow A as illustrated in FIG. 1, being moved by independent rotational means (not shown).

Adjacent both the lower edge of the impact table 1 and the crusher means is the crusher grate which includes an axle 4, also horizontally disposed and positioned parallel to both the lower edge of the impact table 1 and the horizontal shaft 2. A plurality of circular discs 5 are mounted to the axle 4 and fixed thereto. The axle 4 intersects and passes through the central axis of the circular discs 5. The circular discs 5 are spaced apart as illustrated in FIG. 2. The axle 4 is rotatably mounted (not shown) but is not driven by independent means.

The crusher arms 3 are movable between the circular discs 5 in operation but do not produce contact, as illustrated in FIGS. 1 and 2. The circular discs 5 rotate, in operation, in the direction of arrow B in FIG. 1.

In operation, sinter material is fed by gravity onto the impact table 1, then slides down the slope of the impact table 1 into contact with the crusher arms 3. As the crusher arms 3 are rotated in the direction of arrow A of FIG. 1, the sinter material is forced downward through the spaces between the circular discs 5. Sinter material that is too large to pass through the spaces between the circular discs 5 is sheared off to form smaller pieces by the coaction of the crusher arms 3 with the circular discs 5. The movement of the sinter material through the spaces between the circular discs 5 causes the circular discs 5 and the axle 4 to rotate, continuously changing the peripheral edge of the circular discs against which sinter material is sheared.

Heat buildup in the circular discs 5, caused by contact with hot sinter material, is controlled by nozzles 6 positioned to spray water onto the peripheral edges of the circular discs 5 away from the work area of the crusher device.

Figure 3:
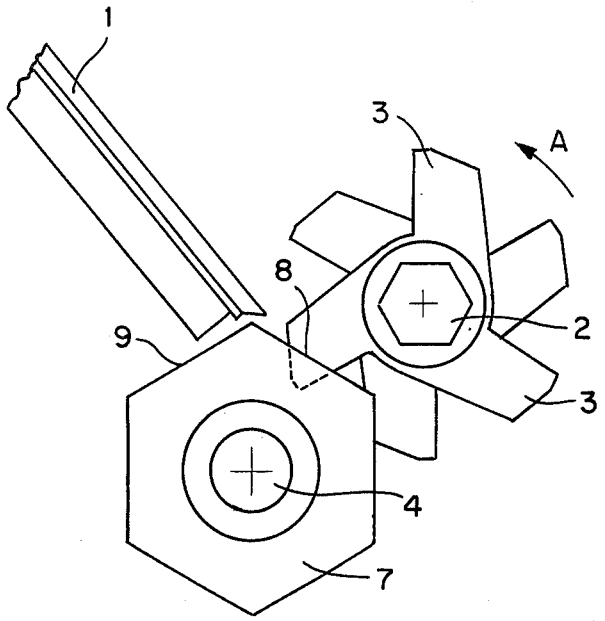
FIG. 3 is a side view of an alternate embodiment of the crushing device, as provided with polygonal discs, in schematic form.

FIG. 3 illustrates an alternate embodiment of the crusher grate in which a plurality of polygonal discs 7 are used rather than circular discs. The flat surfaces of each of the polygonal discs 7 are parallel with each other, the polygonal discs 7 being mounted to axle 4 in the same manner and with the same spacing as the circular discs 5 of FIGS. 1 and 2. In this embodiment, the axle 4 is rotatably mounted, for example, in bearing means (not shown) as are well known to those skilled in the art, but means to prevent rotation of axle 4 is also employed also not shown.

The sloped surfaces 8, as illustrated in FIG. 3, in the upper area of the polygonal discs 7 operate in the conventional manner of a beam grate. However, when sloped surfaces 8 show wear, shaft 4 and polygonal disc 7 are rotated until side 9, for example, is brought into the position of sloped surface 8 as shown in FIG. 3.

As illustrated previously in FIGS. 1 and 2, again in this embodiment a sloped impact table 1 is utilized to absorb the impact shock of deploying sinter material.

According to the provisions of the patent statute, the principle, preferred construction and mode of operation of the present invention have been illustrated and described in what is now considered to represent its best embodiment. However, it is to be understood that, within the scope of the appended claims, the invention may be practiced otherwise than as specifically illustrated and described.

What is claimed is:

1. A device for crushing sinter material and the like, comprising:

(a) a horizontal shaft rotatably mounted;

(b) a plurality of crusher arms spaced apart and fixed to said horizontal shaft;

(c) means for rotating said horizontal shaft;

(d) a horizontal axle freely rotatably mounted and positioned parallel to said horizontal shaft;

(e) a plurality of discs, disposed parallel to each other and spaced apart, fixed to said horizontal axle, said horizontal axle intersecting said discs through the central axle of said discs, said discs positioned, in relation to said crusher arms, to allow said crusher arms to move through said spaced apart relationship of said discs;

(f) an impact table disposed directly above and adjacent to said discs in a position sloped to absorb the impact of sinter material or the like which falls onto said impact table and thence slides directly onto said plurality of said crusher arms, said impact table also being adjacent to said plurality of said crusher arms.

2. A device for crushing sinter material and the like as described in claim 1 wherein said discs are polygonal having flat edges thereon, said flat edges of each of said discs being parallel to the corresponding flat edges of each other of said discs.

3. A device for crushing sinter material and the like as described in claim 1 wherein said discs are circular.

4. A device for crushing sinter material and the like as described in claim 1 further comprising means for cooling said discs operating upon said discs away from the work zone of said discs.

5. A device for crushing sinter material and the like as described in claim 4 wherein said discs are circular.

* * * * *